US007938297B2

(12) United States Patent
Law et al.

(10) Patent No.: US 7,938,297 B2
(45) **Date of Patent: *May 10, 2011**

(54) PUMP DISPENSERS

(75) Inventors: Brian Robert Law, Leicester (GB); David John Pritchett, Ashby de la Zouch (GB); Jeffrey William Spencer, Leicester (GB)

(73) Assignee: Rieke Corporation, Auburn, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/629,449

(22) Filed: Dec. 2, 2009

(65) Prior Publication Data

US 2010/0096412 A1 Apr. 22, 2010

Related U.S. Application Data

(63) Continuation of application No. 11/801,055, filed on May 8, 2007, now Pat. No. 7,641,077, which is a continuation of application No. 10/511,782, filed as application No. PCT/GB03/01685 on Apr. 17, 2003, now Pat. No. 7,461,762.

(30) Foreign Application Priority Data

Apr. 17, 2002 (GB) ..... 0208806.0

(51) Int. Cl.
*B67D 7/76* (2010.01)

(52) U.S. Cl. ..... 222/190; 222/181.1; 222/137; 222/321.2; 222/464.7; 239/337

(58) Field of Classification Search ..... 222/190, 222/181.1, 137, 321.2, 464.7, 181.2, 181.3, 222/321.9; 239/337
See application file for complete search history.

(56) References Cited

U.S. PATENT DOCUMENTS

| | | | |
|---|---|---|---|
| 2,774,517 | A | 12/1956 | Teegardin et al. |
| 3,379,136 | A | 4/1968 | Corsette |
| 4,118,152 | A | 10/1978 | Bron |
| 4,277,001 | A | 7/1981 | Nozawa |
| 4,286,736 | A | 9/1981 | Corsette et al. |
| 4,360,130 | A | 11/1982 | Nishimura et al. |
| 4,364,718 | A | 12/1982 | Beun et al. |
| 4,589,573 | A | 5/1986 | Tada |

(Continued)

FOREIGN PATENT DOCUMENTS

DE 39 29 064 A 1/1991

(Continued)

OTHER PUBLICATIONS

European Patent Application 04 25 5318 Search Report mailed Jun. 14, 2006.

(Continued)

*Primary Examiner* — Kenneth Bomberg
*Assistant Examiner* — Melvin A Cartagena
(74) *Attorney, Agent, or Firm* — Woodard, Emhardt, Moriarty, McNett & Henry LLP

(57) ABSTRACT

Certain pump dispensers, for example foam dispensers, are specially adapted for inverted use. One feature especially useful in a foam dispenser having both an air cylinder and a liquid cylinder with respective pistons is an intake conduit arrangement to increase the clearance of liquid from the container. An intermediate shell fits over the upright liquid cylinder body and carries an inlet valve positively urged upward to the closed position to prevent leaking. A conduit shell fits over the intermediate shell and creates an intake conduit extending down the side of the liquid cylinder to an intake opening lower down the pump body.

14 Claims, 8 Drawing Sheets

U.S. PATENT DOCUMENTS

| | | | |
|---|---|---|---|
| 4,673,109 | A | 6/1987 | Cassia |
| 4,775,079 | A | 10/1988 | Grothoff |
| 4,776,498 | A | 10/1988 | Maerte et al. |
| 4,958,752 | A | 9/1990 | Maerte et al. |
| 5,016,780 | A | 5/1991 | Moretti |
| 5,115,980 | A | 5/1992 | Skorka |
| 5,165,577 | A | 11/1992 | Ophardt |
| 5,282,552 | A | 2/1994 | Ophardt |
| 5,353,969 | A | 10/1994 | Balderrama |
| 5,373,970 | A | 12/1994 | Ophardt |
| 5,401,148 | A | 3/1995 | Foster et al. |
| 5,431,309 | A | 7/1995 | Ophardt |
| 5,445,288 | A | 8/1995 | Banks |
| 5,489,044 | A | 2/1996 | Ophardt |
| 5,676,277 | A | 10/1997 | Ophardt |
| 5,738,250 | A | 4/1998 | Gillingham et al. |
| 5,813,576 | A | 9/1998 | Iizuka et al. |
| 5,975,360 | A | 11/1999 | Ophardt |
| 5,988,456 | A | 11/1999 | Laible |
| 6,045,008 | A | 4/2000 | Gonzalez et al. |
| 6,082,586 | A | 7/2000 | Banks |
| 6,126,042 | A | 10/2000 | Meshberg |
| 6,343,724 | B1 | 2/2002 | Ophardt et al. |
| 6,409,050 | B1 | 6/2002 | Ophardt et al. |
| 6,516,976 | B2 | 2/2003 | Lewis et al. |
| 6,533,145 | B2 | 3/2003 | Lewis et al. |
| 6,540,117 | B2 | 4/2003 | Powling |
| 6,540,157 | B2 | 4/2003 | Ophardt |
| 6,543,651 | B2 | 4/2003 | Lewis et al. |
| 6,557,736 | B1 | 5/2003 | Ophardt |
| 6,575,334 | B2 | 6/2003 | Lewis et al. |
| 6,575,335 | B2 | 6/2003 | Lewis et al. |
| 6,601,736 | B2 | 8/2003 | Ophardt et al. |
| 7,004,356 | B1 | 2/2006 | Sayers |
| 7,011,237 | B1 | 3/2006 | Sayers et al. |
| 7,325,704 | B2 | 2/2008 | Kasting |
| 2003/0201286 | A1 | 10/2003 | Ophardt |
| 2004/0217137 | A1 | 11/2004 | Ophardt |
| 2005/0051579 | A1 | 3/2005 | Kasting |

FOREIGN PATENT DOCUMENTS

| | | | |
|---|---|---|---|
| EP | 0 389 688 | A2 | 10/1990 |
| EP | 0 703 831 | B1 | 12/1998 |
| EP | 1 190 775 | A1 | 3/2002 |
| EP | 1 514 607 | A2 | 3/2005 |
| JP | H08-011921 | A | 1/1996 |
| WO | WO 99/49769 | A1 | 10/1999 |

OTHER PUBLICATIONS

European Patent Application 05256914.2 Extended Search Report mailed Mar. 2, 2006.

Hygiene-Technik Inc., A member of the Ophardt Group of Companies, UX10 Lotion or Foam Soap Dispenser, 2004, pp. 2.

Pictures of Umbrella Valve from RD Industries of Omaha, Nebraska (Pictures 1-6), Jan. 4, 2005.

PUMP DISPENSERS

CROSS-REFERENCE TO RELATED APPLICATION

This application is a continuation of U.S. application Ser. No. 11/801,055 filed May 8, 2007, which is a continuation of U.S. application Ser. No. 10/511,782, filed May 2, 2005, now U.S. Pat. No. 7,461,762, which is a 371 national stage of International Application No. PCT/GB2003/01685 filed Apr. 17, 2003, which claims the benefit of United Kingdom Application No. 0208806.0, filed Apr. 17, 2002, the entire disclosures of which are hereby incorporated by reference.

FIELD OF THE INVENTION

This application relates to developments in relation to dispenser pumps. Particular aspects are relevant to inverted dispensers, most particularly dispenser pumps which dispense foam. Another aspect relates to the venting of a container fitted with a pump dispenser.

BACKGROUND

Our earlier application EP-A-1190775 describes various developments in relation to dispenser pumps adapted to dispense foam by combining pumped flows of air and liquid and passing them through a permeable foaming element. While the concepts and indeed the embodiments described in the earlier application may—as a skilled person would readily appreciate—be used in or adapted for any inverted dispenser, we have now made some further developments particularly appropriate for an inverted dispenser. We have also made some further developments usable in but not necessarily limited to use in inverted dispensers.

Inverted dispensers e.g. for liquid soap and the like are well known in themselves. Typically they involve some housing or mounting on which a container is mounted upside down, with a mouth of the container communicating with the intake of a dispenser pump. The pump is operated by a reciprocating action to move its pump piston. Usually the pump piston is arranged more or less upright, but this is not essential. The dispenser arrangement may include a mechanism whereby movement of an operating part with a substantial horizontal component—this being usually more convenient for the user—is converted to a driving movement along the line of the pump plunger axis e.g. by cams, pivots and the like.

Inverted pump dispensers adapted to dispense foam have also been proposed before; see e.g. U.S. Pat. No. 5,445,288 (EP 703831) describing a system for use with collapsible containers, also WO 99/49769.

Certain aspects of the present proposals relate to dispensers (referred to in what follows as "of the kind described") which combine a liquid pump and an air pump mounted at, or adapted to be mounted at, the neck of a container which contains foamable liquid. The liquid pump has a liquid pump chamber defined between a liquid cylinder and a liquid piston, and the air pump has an air pump chamber defined between an air cylinder and an air piston. Preferably these components are arranged concentrically around a plunger axis of the pump. The liquid piston and air piston are reciprocable together in their respective cylinders by the action of a pump plunger; typically the two pistons are integrated with the plunger. Appropriate flow valves are provided to assure the operation of the respective pumps. Thus, the air chamber typically has an air inlet valve. The liquid chamber usually has a liquid inlet valve. An air discharge passage and a liquid discharge passage lead from the respective chambers to an outlet passage by way of a permeable foam-regulating element, preferably having one or more mesh layers or other porous formation, through which the air and liquid pass as a mixture. The air discharge passage and liquid discharge passage may meet in a mixing chamber or mixing region upstream of the permeable foam-generating element. Either or both of an air outlet valve and a liquid outlet valve may be provided for the air discharge passage and the liquid discharge passage respectively. Preferably the discharge nozzle is a movable nozzle comprised in the plunger, with the foam-regulating element.

Our earlier application EP-A-1190775 discloses various proposals relating to the feeding of external air to the air cylinder, to the construction of an air inlet valve integrally with the air piston or a portion thereof, to possible constructions for a mixing chamber for liquid and air, to a novel disposition of the discharge passageways, and to arrangements for venting air into the container. The present pumps may incorporate any one or more of those earlier proposals.

A first aspect of the present invention in the context of an inverted dispenser, preferably a foam dispenser of the kind described, is the provision of an intake conduit for the liquid pump specially adapted to improve the clearance of liquid from the inverted container. Typically the liquid pump cylinder projects up (in the inverted configuration) into the container space to an appreciable extent. If the intake opening to the liquid pump chamber—typically having a liquid inlet valve—is at this upper end of the pump body, then depending on the shape of the container neck and pump mounting there may be a significant body of liquid in the system below the level of the intake opening. To avoid wasting this liquid, we propose providing an intake conduit communicating at its downstream end with the inlet opening to the liquid pump chamber and extending downwardly from there to a lower intake opening at its upstream end. This liquid conduit may extend down alongside the liquid cylinder (and/or the air cylinder, in a foam dispenser) of the pump arrangement. Its intake opening (upstream end) preferably lies below the axial position of the seal of the liquid piston, in the inverted (operating) position of the dispenser with the plunger in its downward position.

The conduit may be provided as a dip tube extending down from a releasable connection at the intake end of the liquid pump chamber.

More preferably however the conduit is provided by means of a conduit shell component that fits onto the cylinder body. Preferably it is a tube fitting over the cylinder body and held in place by interference and/or a snap or other engagement with the pump body. The intake conduit can then be created by a clearance up between the cylinder body and conduit shell, preferably a circumferentially-localised clearance in the form of a groove or channel, extending up the side of the cylinder body to a top enclosed portion of the shell communicating with the cylinder body inlet opening. A fitting shell of this kind is easily made by moulding, and simple to assemble. It extends as far down around the cylinder body as is practicable, having in mind the desire to clear the maximum proportion of liquid from the container. Preferably it extends at least halfway down the stroke of the liquid-pumping piston, and more preferably no higher than the lowermost position of that piston. Where the dispenser is a foam dispenser, with coaxial liquid and air cylinders, the intake conduit may extend down over all or part of the axial extent of the air cylinder. However since the air cylinder is normally much wider than the liquid cylinder, and often occupies most of the area of the neck, its length accounts for only a small proportion of liquid volume lost, especially with a collapsible container. So, for economy and compactness, we prefer an embodiment in which the lower end of the conduit shell terminates adjacent the junction between the liquid cylinder and air cylinder, and has the intake opening(s) there. In an embodiment where there is an outward diameter step from the liquid cylinder to the air cylinder, the lower end of the shell may conveniently terminate—e.g. with an anchoring engagement—at that position. Preferred foamer designs have a cylinder unit with the air cylinder wall folded back to form a re-entrant trough at the junction with the liquid cylinder, to reduce axial length. Conveniently a lower end of the conduit shell, e.g. a flared skirt formation, fits into this trough. It may cover and close the trough, with the intake opening(s) defined through the skirt formation.

A further proposal relates to an inlet valve for the liquid chamber, in any of the versions proposed above. In this proposal the inlet valve is resiliently urged to a closed position, so that in the rest condition of the pump it prevents liquid from flowing from the container into the liquid chamber. This may be achieved by a upwardly-sprung valve body, or more preferably by a resilient valve member. In a preferred feature the inlet valve is provided as part of the intake conduit arrangement, discrete from but fitting onto the cylinder body itself.

A preferred embodiment of this uses an intermediate shell fitting over the cylinder body proper, e.g. in between the cylinder body and a conduit shell as proposed above. This intermediate shell—which can be a tube, closed at its top end except for one or more intermediate inlet openings governed by the inlet valve—serves the additional/alternative function of providing a fitting outward surface to complement the inward surface of the conduit shell. Again, it is easy to form this intermediate shell by moulding.

The skilled person will note an advantage of the various proposals above, namely that they enable the construction of an inverted dispenser using components per se suitable for an upright dispenser. The intake conduit arrangement cures the deficiency of an upright dispenser when inverted, namely the high position of its liquid intake. The auxiliary valve attachment deals with the feature that the inlet valve of an upright dispenser is often free, i.e. urged only by gravity towards its closed position (because in an upright dispenser there is no tendency of the liquid to rise into the chamber), which would lead to possible large-scale leakage in an inverted dispenser. Furthermore, in the preferred embodiments above, all these effects and advantages can be achieved using simply moulded components.

A further proposal herein, particularly suitable for an inverted foam dispenser of the kind described, relates to the intake of pumping air (i.e. air for pumping to create foam, as distinct from air gradually vented into the container to compensate for the volume of liquid dispensed). The operating plunger has an outer shroud wall enclosing an interior cavity. Typically the discharge passage extends through this interior cavity, surrounded by an internal core structure which desirably includes separable structures for removably retaining the permeable foam-regulation element such as a mesh. The air intake to the air cylinder is via this cavity, beginning at an air intake vent through the shroud wall (not through the discharge passage and discharge opening). An inlet valve for the air cylinder is preferably substantially above the bottom of the plunger interior cavity, e.g. in a roof portion of the air piston, preferably aligned axially with an air outlet valve leading to the air discharge passage. As explained in our earlier application, intake of air via the plunger interior cavity from an external opening in the shroud is desirable because among other things it enables the intake opening to be easily masked or covered or otherwise protected against the entry of water. Thus, in the presently inverted dispenser it may open at a downwardly-directed surface of the plunger shroud.

In this context the proposal herein—independent from those above—is to form the plunger shroud with an air vent riser conduit whose entry is the external opening through the shroud and which extends up in the is plunger to an exit opening raised from the floor of the interior cavity, and preferably more than half way up that cavity. Such a riser conduit may be formed as a clearance between opposed surfaces of interfitting plunger shroud components, e.g. a side wall and an end cap, or as an upstanding tubular formation integral with the plunger's bottom wall, e.g. an end cap component thereof.

The virtue of this proposal is in preventing possible dripping from the vent. With the rigors of use, is not impossible that some liquid gets into the air pumping system and this naturally tends to leak to the lowest point which is the plunger cavity. By raising the inner opening of the vent away from the floor of this cavity, dripping from the vent can be prevented. A further proposal herein is a distinction from our earlier patent. That is, the air piston comprises its piston seal (engaging the cylinder wall) as a component separate from that forming the air inlet valve. In our previous proposal, it was an advantage to form these in one piece. Both require flexible, resilient sealing lip behavior. However in an inverted dispenser and in some upright dispensers actuation forces are commonly off-axis, either manually or by an actuating mechanism. With a generally soft piston material, these off-axis forces can cause deformation leading to leakage. What we now propose in an inverted or upright dispenser is to make the piston seal component from harder plastics material than the air inlet valve component. Preferably the outward engagement of the air piston with the air cylinder wall is axially distributed, to improve the axial guiding of the assembly. This may be by forming the piston seal with axially-spaced double lips. Additionally or alternatively the piston component may connect directly to the plunger shroud component for greater strength, the valve component of more flexible material being separately connected (perhaps to the separate connector of the plunger shroud, or to the pump core surrounding the discharge passage). One embodiment of this 'direct connection' is to form the air piston including its piston seal portion in one piece with the plunger shroud that extends outside the pump's retaining cap and which in one aspect (described elsewhere) surrounds an interior cavity of the plunger created in a radial spacing between that shroud and a core sleeve of the plunger around the discharge channel. This is practical for moulding when the plunger has a discrete end plug component closing off the shroud wall to provide any transverse structure (and preferably a pumping air vent as described elsewhere).

A further aspect herein relates to the admission of venting air into the container, i.e. to compensate for the volume of liquid dispensed. This presents issues in an inverted dispenser because the entry of the vent path into the container interior is necessarily submerged in use. It must have a valve. In fact, such a valve is also desirable in upright dispensers to prevent leakage e.g. during shipping. Some upright designs admit air through clearances in and around the pump body. Known foamer pumps admit air to the container through the air pump system, via a valved hole in the air cylinder wall. This is definitely unsuitable for an inverted dispenser. Other known designs including foamers exploit the small clearance between a threaded retaining cap of the pump and the outside of the container neck onto which it is screwed. The threads will admit a small flow of air, and by providing suitable clearance between the edge of the container neck and the underside of the cap, e.g. by notches in the cap, or by insertion of a packing member with one or more grooves, holes or other recesses, this air can reach the container interior around the pump body. The difficulty is in the valving. Known constructions trap an annular valve element with a flexible annular lip between the neck edge and cap (or pump body flange) underside. It will be an advantage to vent through structure between the neck edge and cylinder flange because the other side of the cylinder flange can then connect fully to the opposed cap, e.g. by a snap connection using an annular skirt or rib on the flange, which improves strength and can facilitate assembly. The valve lip seats inwardly against the pump body (cylinder) exterior, or upwardly against one or more vent holes through a packing element as mentioned above. However the effectiveness of these valve seals tends to decrease markedly with time.

A further proposal in this respect is therefore a pump dispenser having a pump with a pump body recessed into the neck of a container for product to be dispensed by the pump, the pump also having a retaining cap which connects to the pump body and is adapted to engage the outside of the container neck e.g. by screw threads to hold the pump body in place. A vent path for allowing the entry of air into the container interior, to compensate for dispensed product, is defined between the outside of the neck and the inside of the retaining cap, extending over the edge of the container neck and into the container via a radial clearance between the pump body and the inside of the container neck. This may be an upright or inverted dispenser, and the pump may be a liquid-only pump or a foam pump which pumps both liquid and air as described elsewhere herein. The characteristic feature is that a vent path seal in the vent path comprises a resilient annular sealing element with an annular sealing lip having a sealing edge acting outwardly against a radially inwardly-directed counter surface. This is preferably an inwardly-directed surface of the retaining cap in a region above the securing formation e.g. threads. The benefit of this construction is that the sealing lip is generally in compression between the counter surface and the remainder—typically an annular support body e.g. of elastomer—of the sealing element. This contrasts with designs in which an annular sealing lip is tensioned around an outwardly-facing counter surface, or acts as a flap valve with little sealing force. We find that this can significantly improve the effective lifetime of the valve seal, because the seal material withstands compression better than tension in the long term. The preferred form of sealing element is an elastomeric ring trapped stably between the container neck edge and the underside of the pump retaining cap, optionally with one or more other trapped components in between either above or below, (e.g. a pump cylinder retaining flange), and having an outwardly-projecting annular sealing lip engaging against the inwardly-directed surface of the retainer construction and inclined relative to that surface to admit air while preventing escape of liquid. Communication from behind the lip to the container interior is via one or more holes, recesses or channels past or through the sealing ring. For example, the abutting surfaces of either one of the sealing ring and the overlying pump component (retaining cap underside, or cylinder flange) may be traversed by one or more grooves enabling limited flow.

A further independent proposal—which, as with the others, may be combined with any one or more of the other proposals herein—relates to the control of unwanted flow, leaking or drips from a downwardly-directed discharge nozzle of the dispenser, downstream of the foam-generating element. We propose a closure valve for the discharge nozzle comprising a wall of resiliently flexible material having one or more discharge openings e.g. in slit form, closed in a rest condition of the wall and open when the wall is caused to bulge outwardly under pressure from product discharged from the pump. A rubber membrane with one or more slit openings is preferred e.g. crossed slits. Preferably the wall is downwardly concave, so that under forward fluid pressure it must pass through a peak of compressive strain before reaching a wholly or partially outwardly convex configuration in which the discharge opening opens. Closure valves of this kind are known as such. They offer the advantage of a positive closure action when pump pressure is relieved, because the resilient restoration of the material presses the sides of the discharge opening(s) together as the wall returns to its rest condition.

BRIEF DESCRIPTION OF THE DRAWINGS

Embodiments of the invention are now described by way of example with reference to the accompanying drawings in which.

DESCRIPTION OF THE SELECTED EMBODIMENTS

Figure 1:
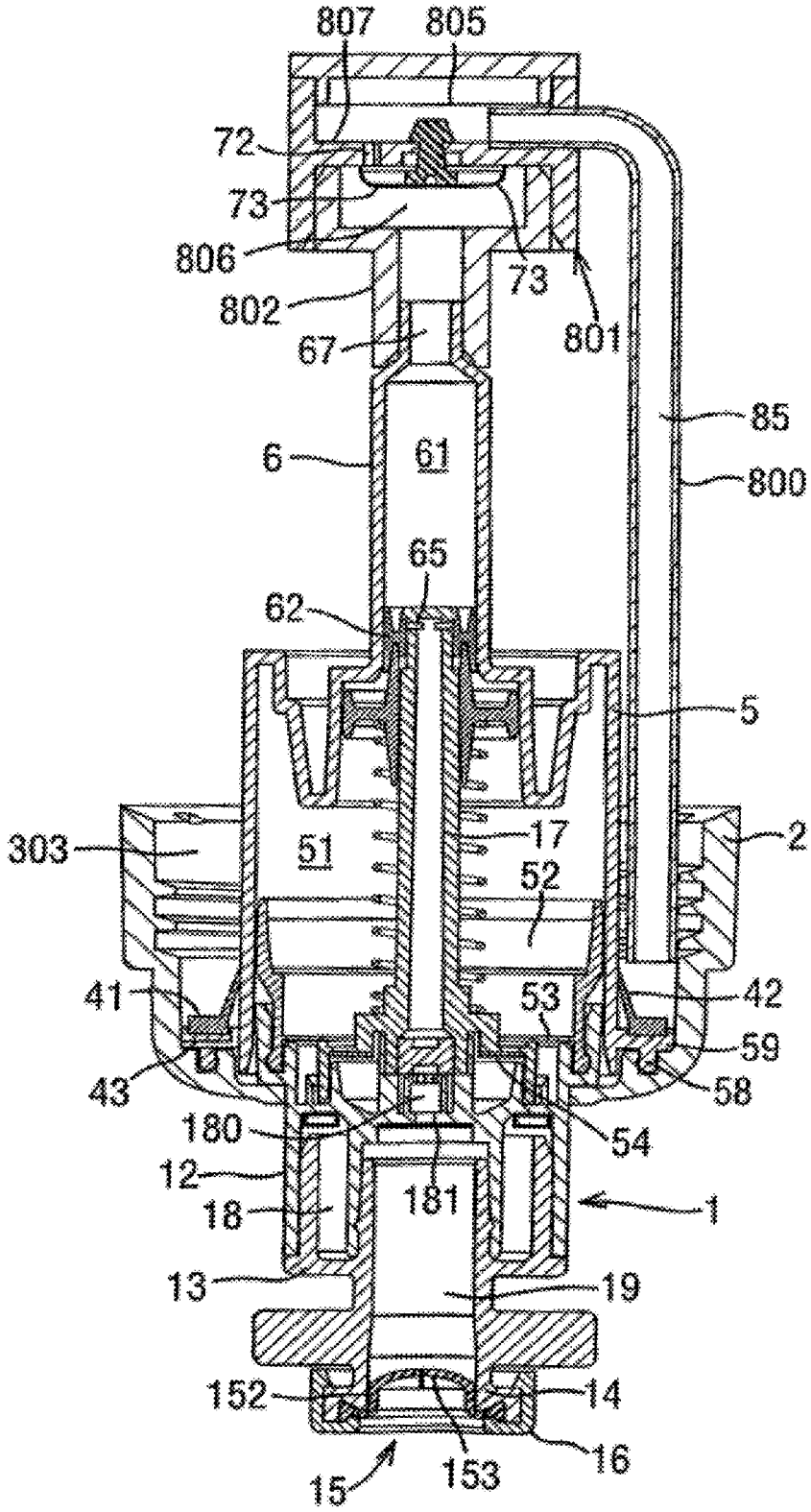
FIG. 1 is an axial section of an inverted pump for a foam dispenser.

FIG. 1 shows an inverted foaming dispenser with functional components corresponding broadly with those described in our earlier application mentioned above. Thus, a plunger 1 carries an air piston 52 which acts in an air cylinder 5 defining an air chamber 51. The air cylinder 5 is formed integrally with a smaller-diameter liquid cylinder 6 which projects vertically up into the container space (container not shown). The elongate hollow plunger stem 17 carries a liquid piston 62 acting in the liquid cylinder 6. The liquid piston 62 is mounted slidably on the end of the stem 17 which has sideways end openings to its central channel, so that the piston acts as an outlet valve 65. Air inlet and outlet valves are provided at the bottom of the air chamber 51, by means of resiliently flexible plastic flap components of the plunger/piston assembly. The air inlet valve 53 communicates with an internal cavity 18 of the plunger 1, defined between its main outer sleeve or shroud component 12 and an end plug component 13 including a central downwardly-directed discharge spout 14. Air for pumping is admitted via this chamber 18, at an air vent hole (see later). During pumping liquid and air are pumped simultaneously from their respective chambers 61,51 and meet at a mixing region 180 immediately above a foam regulating element 181 provided by a trapped annulus carrying meshes, and housed in a socket defined between the central projecting core tubes of the plunger elements 12,13. The discharge channel 19 through the end plug 13 terminates at a spout opening 14 closed off by a rubber anti-drip valve 15, fixed in the nozzle opening by a clamping ring 16. This valve 15 has an annular front securing bead trapped by the ring 16, a cylindrical rearwardly-extending continuous side wall 152 and a concave closure wall 153 traversed by a pair of crossed slits. These valves are known as such, obtainable e.g. from Zeller. Normally the closure slits are fully shut, and prevent dripping. Under pressure from dispensed product, the closure wall 153 bulges forward, opening the slits for the passage of foam. When pump pressure is released the closure wall 153 spontaneously retracts, closing the slits and preventing subsequent dripping. It also leaves the opening of the nozzle clear of product so that a user reaching underneath does not unexpectedly get product on their hands before operating the pump.

The air and liquid cylinders 5,6 in this pump are coaxial and, as in the upright dispensers of our previous application, their axial lengths are substantially cumulative. In fact, this unit is a unit suitable for an upright dispenser, turned upside down. The inlet spigot 67 of the liquid cylinder opens well above the bottom of a body of liquid in the container. To enable dispensing of this liquid, an adaptor body 801 plugs onto the liquid cylinder by a socket 802 fitting onto the spigot 67. The adaptor body 801 is divided internally into upper and lower chambers 805,806 separated by an intermediate 807 having a set of flow openings 72 governed by a resilient umbrella-shaped valve member 73. The valve member 73 is anchored at its centre through the partition 807, and urged by its elasticity towards the closed position. The dip tube 85 extends down alongside the liquid cylinder 6 and air cylinder 5, reaching down to the space 303 in between the outer securing cap 2 and the wall of the air cylinder 5. Thus, this liquid can be pumped from the container even though its level is far below the direct intake 67 to the liquid chamber 61.

Note that, because the valve 73 is positively urged to its closed position, liquid cannot enter the pump chamber 61 from the container under a head of pressure in the container. This is important because, in the event that the plunger 1 for any reason did not return to its fully extended position, the sliding seal valve 65 might not close leaving a leakage path from the liquid chamber 61.

Figure 2:
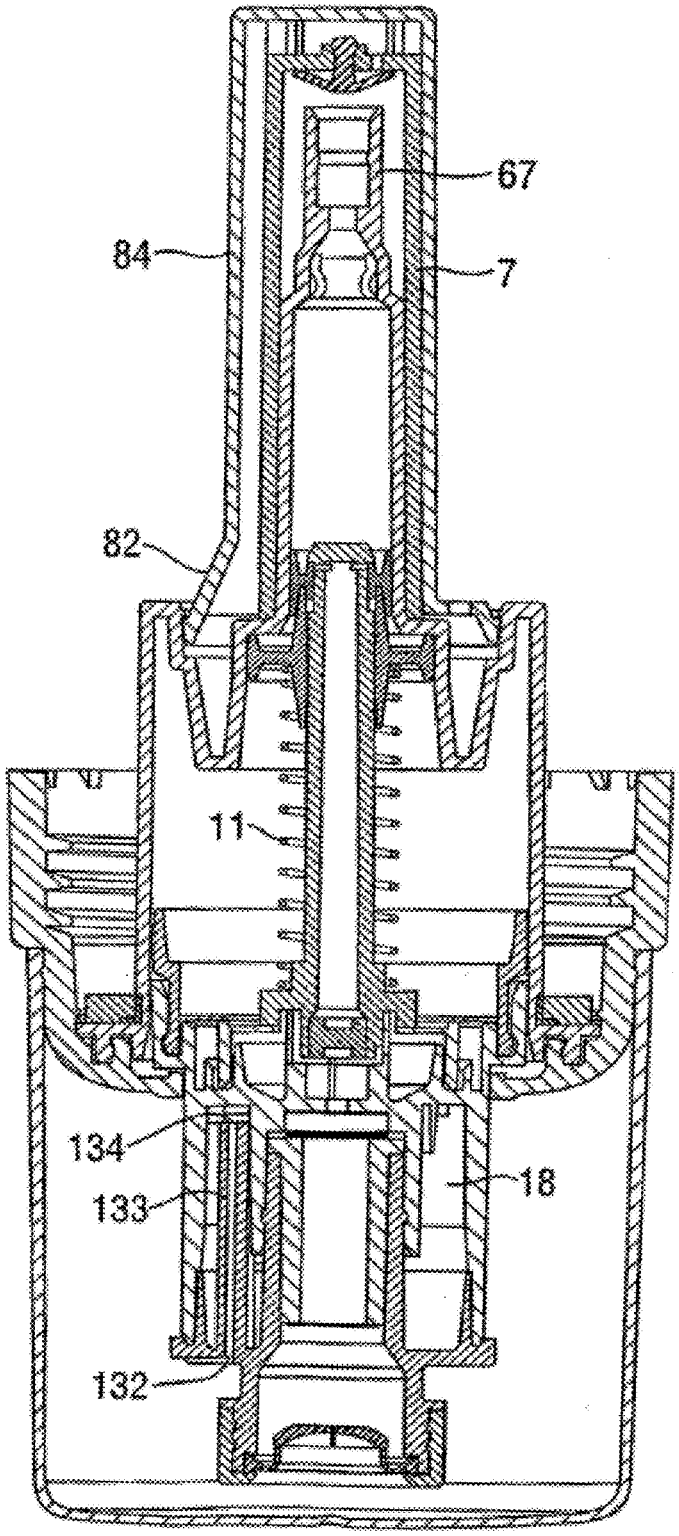
FIG. 2 is a similar axial section of a second embodiment of foamer pump for an inverted dispenser.
Figure 3:
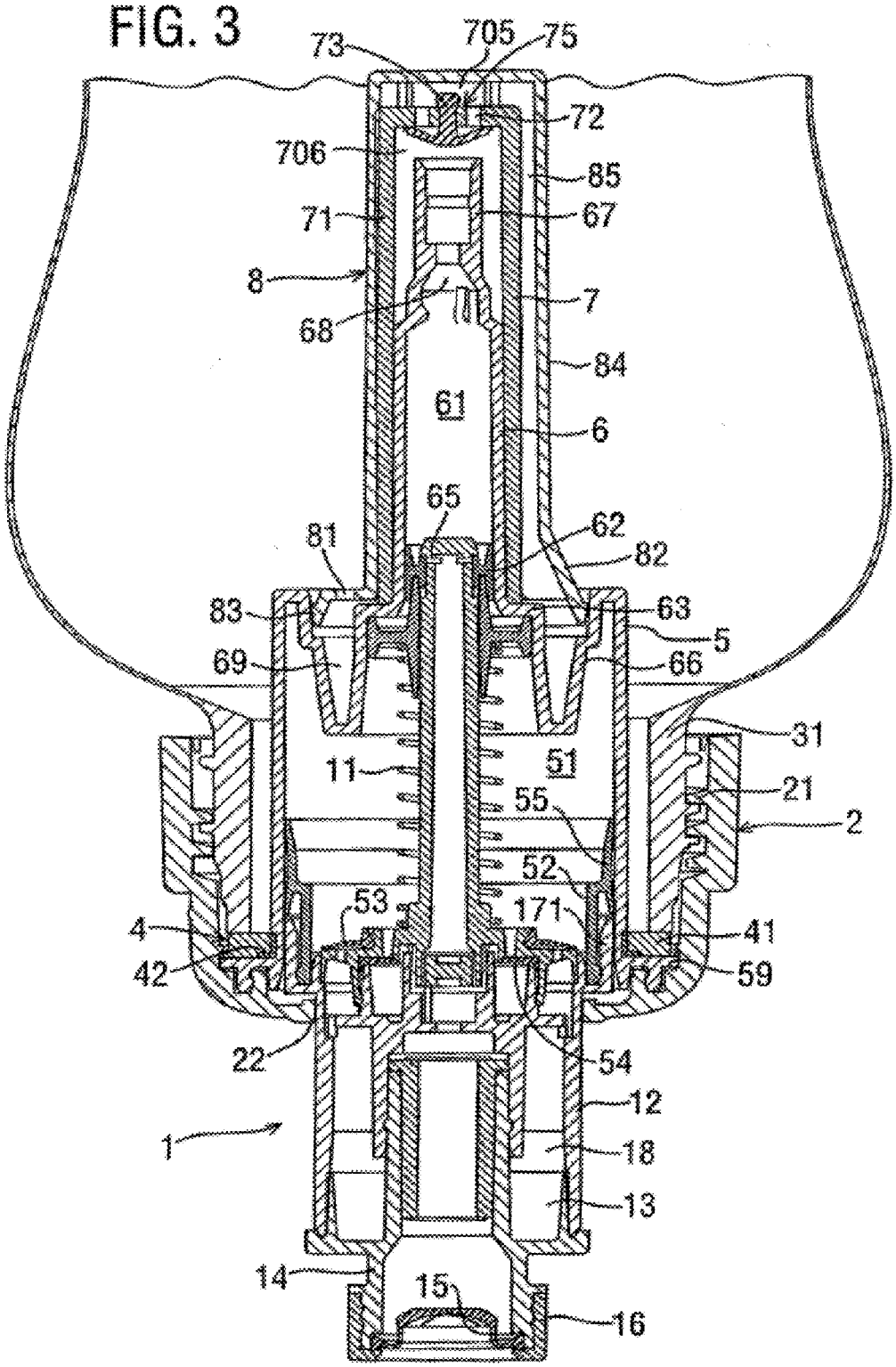
FIG. 3 is an axial section of a third embodiment of inverted foam dispenser, showing the pump attached to a collapsible container.

FIGS. 2 to 5 show a dispenser used with an inverted collapsible bag container 3. The FIG. 2 version differs from the FIGS. 3 to 5 version in the air valving construction, but they are now described together as regards components which are the same. FIG. 3 shows the collapsible bag container 3 in position, with its thickened threaded neck 31 screwed into the threads 21 of the pump cap retainer 2. Because the container 3 is collapsible, there is no need to vent air and accordingly a full seal is made by the packing ring 4 clamped between the edge of the container neck 31 and the upper surface of the pump cylinder flange 59 trapped by the retaining cap 2. Note that the large-diameter air cylinder 5 occupies almost the entire volume within the container neck, and that its part projecting above the container neck region has its displacement reduced, being a re-entrant fold forming a trough 69 with a outer wall 66 meeting an inner wall which extends up to form the liquid cylinder 6. So, in this system the loss of dispensable liquid over the axial length of the air cylinder 5 is small. Having this in mind, the conduit intake arrangement shown enables recovery of liquid over the axial height of the liquid cylinder down to the trough 69, with a simple construction that is easy to make and install.

As before, the liquid cylinder 6 is the same as one used in an upright dispenser, and indeed includes a redundant dip tube socket 67 and vacant valve seating 68 (for a gravity-operated ball valve, in an upright dispenser).

An intermediate shell 7 fits over the cylinder body 6 with a tight, sealing fit. The intermediate shell has a plain tubular wall 71 with a slight taper for fitting, its bottom edge seating against the outward step of the cylinder unit at the base of the liquid cylinder. Its upper end has a closure wall 75 with a set of intermediate inlet openings 72 distributed around a central opening which anchors an elastomeric valve element 73. This valve element 73 has an umbrella form, elastomerically urged against the underside of the shell wall 75 to prevent the entry of liquid under the head of pressure in the container should the liquid outlet be left open. An intermediate liquid chamber is thereby formed between the entry port formations 67 of the liquid cylinder 6 and the non-fitting top end of the shell 7. This component therefore contributes a plain exterior surface to the liquid cylinder entity, and also a valve urged to its closed position even when inverted.

A conduit shell 8 fits closely over the intermediate shell 7. Like the intermediate shell the conduit shell 8 is a generally cylindrical moulded one-piece component, and extends over the full length of the liquid cylinder 6. Its lower end has a outwardly flared portion 82 with a terminal annular snap ring 83 which engages behind a corresponding snap bead around the outer wall 66 of the air cylinder trough formation. This retains the shell 8 and also seals it. Around much of the circumference (seen on the left in FIG. 3) the flared skirt 82 is flattened to a radial surface and has there one or more through-holes 81 for entry of liquid from the container into the annular chamber defined between the shell 8 and the cylinder trough 69.

Figure 4:
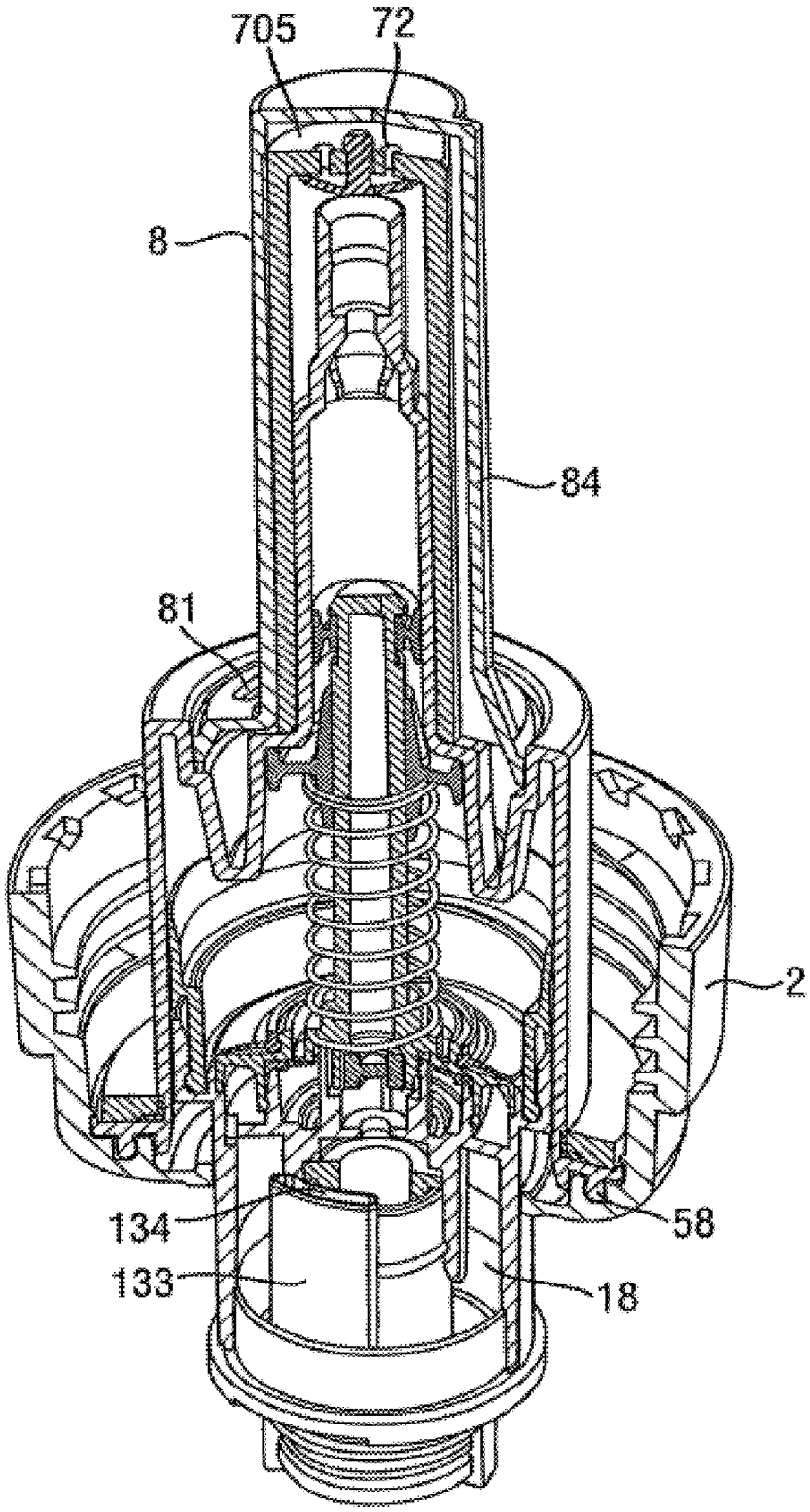
FIGS. 4 and 5 are perspective views showing the interior of the FIG. 3 pump broken away, obliquely from above and below respectively.

The conduit shell 8 fits closely against the intermediate shell 7 all the way round except at one side where it is moulded with an outwardly projecting channel 84 (see also FIG. 4). The resulting clearance creates an intake channel 85 vertically up the side of the liquid chamber and communicating to a clearance 705 between the closed top 85 of the conduit shell and the valved top openings 72 of the intermediate shell 7 beneath. The skilled person will readily appreciate how in use, under the recovery action of the pump spring 11 after a dispensing stroke, the liquid from the container interior is drawn into the liquid chamber 61 via the intake opening(s) 81, trough 69, channel 85, valved intermediate inlet opening 72 and at last through the inlet proper to the liquid cylinder 6. In practice the intermediate chamber 706 also constitutes part of the liquid chamber because it is downstream of the valve, but it is not swept by the piston. As the container 3 empties, it gradually collapses. Its side walls collapse towards one another, so that by the time the container is nearly empty the liquid volume below the top "rim" of the air cylinder construction is negligible: the container walls effectively wrap around the cylinder unit 5,6 and its conduit shroud 8. Thus, almost all product can be cleared. The recessing of the intake opening(s) 81 on the flat step formation keeps the openings low and prevents inadvertent blockage by portions of collapsed container.

This embodiment of dispenser, like the first embodiment, includes a crossed-slit self-actuating closure valve 15 which is not discussed further here.

Figure 5:
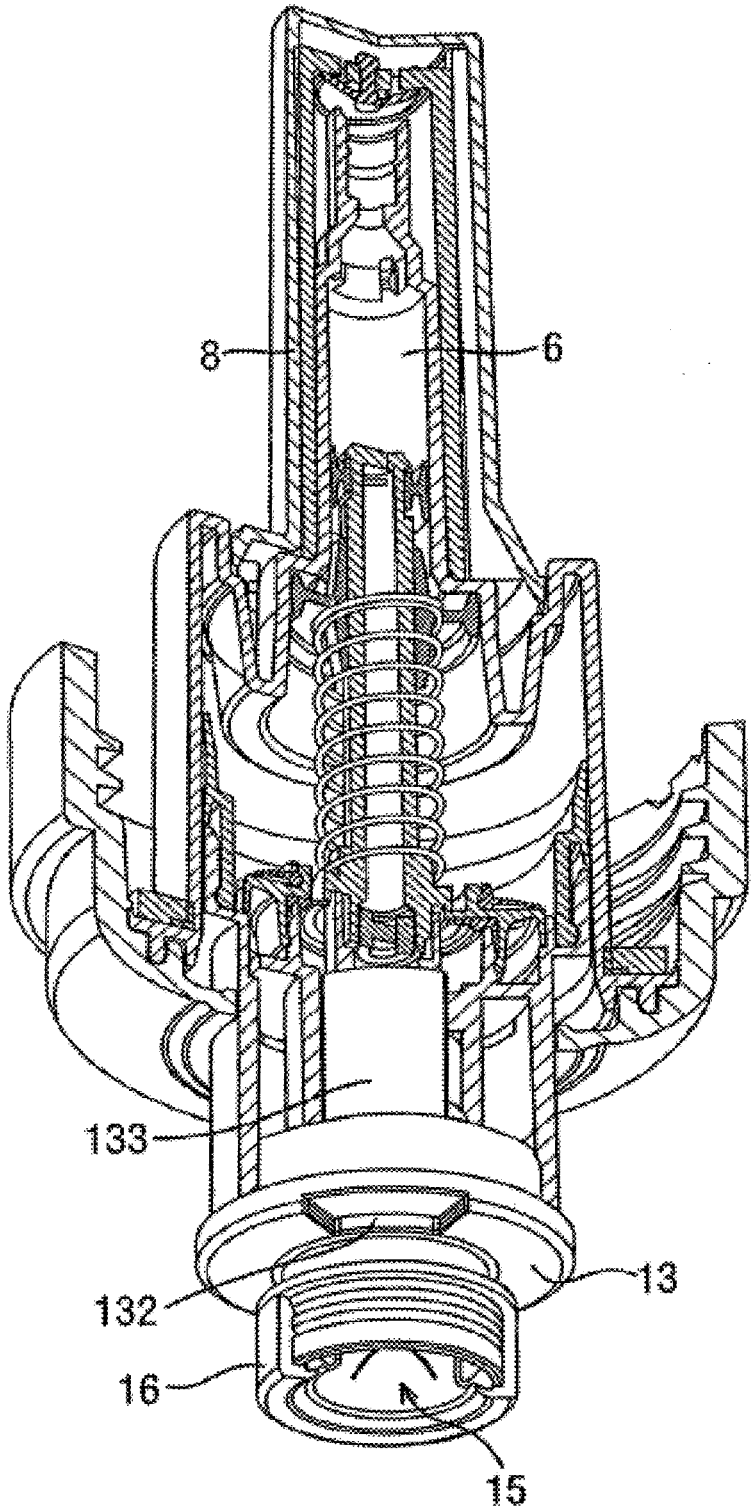

A further feature relates to the vent intake construction for pumping air. As seen in FIGS. 2, 4 and 5, pumping air is admitted to the interior cavity 18 of the plunger head through a vent opening 132 in the downwardly-directed face of the plunger end plug 13. FIGS. 2, 4 and 5 show how the inside of the moulded plug 13 has an integral riser pipe 133 whose inner opening 134 is nearly at the top of the cavity 18 in the plunger. It is possible that with prolonged use (and possible abuse) of the dispenser, liquid may get into the air chamber and, as the air inlet valve 53 is only lightly biased to its closed position, this liquid may find its way under gravity down into the cavity 18. By having the inner opening 134 of the vent as far as possible off the floor of the cavity, dripping of this escaped liquid is prevented while preserving the advantage of having the vent opening 132 on the downwardly-directed surface of the plunger, safe from possible water entry.

A further feature of the present dispensers, differing from those in our earlier application, is a stronger construction of the air piston designed to avoid possible malfunction due to offset loading. Because inverted foamers are normally actuated by means such as a pivoted lever or camming system, the plunger often gets subject to off-axis loads and this can lead to leaks or damage in the long-term. A first measure to address this is that the air piston component 55 is moulded in a substantially rigid polymer, e.g. polypropylene or HDPE. This tubular piston component carrying the piston seal snaps into a corresponding tubular skirt 171 of the plunger, of similarly strong material, and which engages it over a substantial axial area to provide rigidity. Secondly, the piston seal 55 is formed with a dual lip. There might be a tendency for water to be drawn into the air chamber around the outside of the air piston, if the outside of the entire dispenser were wet. The second rearwardly (downwardly) directed sealing lip on the air piston helps to prevent water from getting in in this way. It also provides a deeper axial engagement of the piston with the cylinder 5, better resisting off-axis loads as mentioned above.

In our previous proposal (and in the FIG. 2 embodiment) the air piston was made in one piece with the air inlet valve, exploiting more readily deformable plastics. In the FIGS. 3, 4, 5 embodiment using more rigid plastics for the air piston, the air inlet valve is formed as a discrete softer component 53 clipping onto the pump core.

Figure 6:
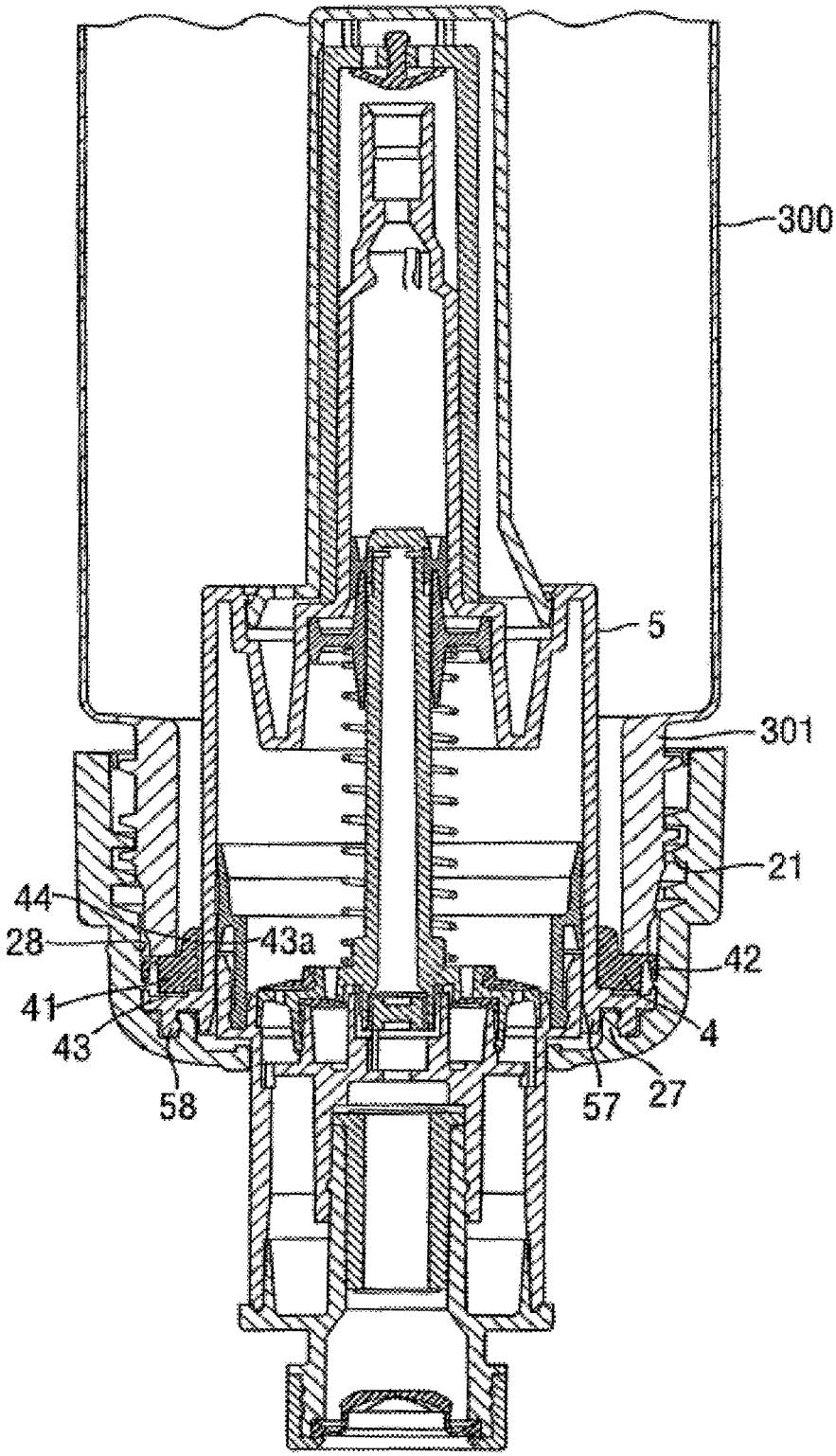
FIG. 6 is an axial cross section of a variant of the FIG. 3 pump dispensed using a rigid container.

The embodiment shown in FIG. 6 is identical to the embodiment of FIG. 3 except that it is designed for use with a rigid container 300. Like the collapsible container of FIG. 3, the rigid container secures to the pump engine by a threaded neck 301. However the rigidity of the container 300 means that provision must be made for admitting air in operation, otherwise pressure reduction in the container would prevent dispensing of liquid. Because the container is inverted, all vent locations associated with the pump are submerged. It is possible in principle to vent the top (i.e. the "base") of the container, but specially-adapted containers are highly impractical. Refer back to FIG. 1 above, which shows an air vent valve 41,42 to enable venting when a rigid container is used. An annular sealing body 41 is disposed around above the piston unit flange, to be clamped against the container neck edge by the retaining cap 2 of the dispenser. A small number of grooves 43 allow passage of air around the sealing ring 41 above the pump body (cylinder unit) flange 58 at locations distributed around the pump. A tapering sealing lip 42 extending integrally from the sealing ring 41 contacts with interference around the outward cylindrical surface of the air piston 5. This allows inward flow of air and prevents outward flow of liquid. Also, venting between flange 59 and neck allows the cylinder unit 5 to be fixed into the inside of the cap 2 by an annular snap rib 58, including a snap bead, received in a corresponding double-sided slot provided in the cap underside by an annular rib there. This strong (and air impermeable) connection facilitates assembly and helps to support the cylinder unit in situ. However we find that with prolonged use, the tension of the lip 42 around the cylinder 5 tends to slacken and the valve becomes less effective.

The embodiment shown in FIG. 6 addresses this while retaining the advantages by providing the valve lip 42 instead to the outside of the trapped seal ring 41, bearing outwardly against the inwardly-directed surface 28 of the retaining cap 2. In this mode the lip 42 is generally in compression. We find that any compression set of the lip material is substantially less serious than the tension slackening experienced with the FIG. 1 embodiment. As before, grooves 43 must be provided between the rubber ring 41 and the adjacent clamped surface to allow the venting air to reach the container interior. The FIG. 6 embodiment stabilizes the ring orientation with (in section) a leg 44 lying against the cylinder wall 5; continuations 43*a* of the vent grooves 43 communicate with the container interior down the inside of the leg. The number of grooves 43 is not critical but preferably is from 2 to 6. This outward vent seal construction is useful not only in inverted dispensers but also in other kinds of dispenser where for any reason venting through the pump mechanism is not desired.

Note again how the cap 2 and cylinder unit 5 lock together by means of a cylindrical snap skirt 58 snapping into a corresponding annular groove provided in the interior of the cap 2 by a complementary cylindrical upstanding skirt 27. These skirts 27, 58 have complementary snap bead/groove formations to make a fixed, sealed connection that helps to fix the axial alignment of the cylinder unit.

Figures 7, 7A:
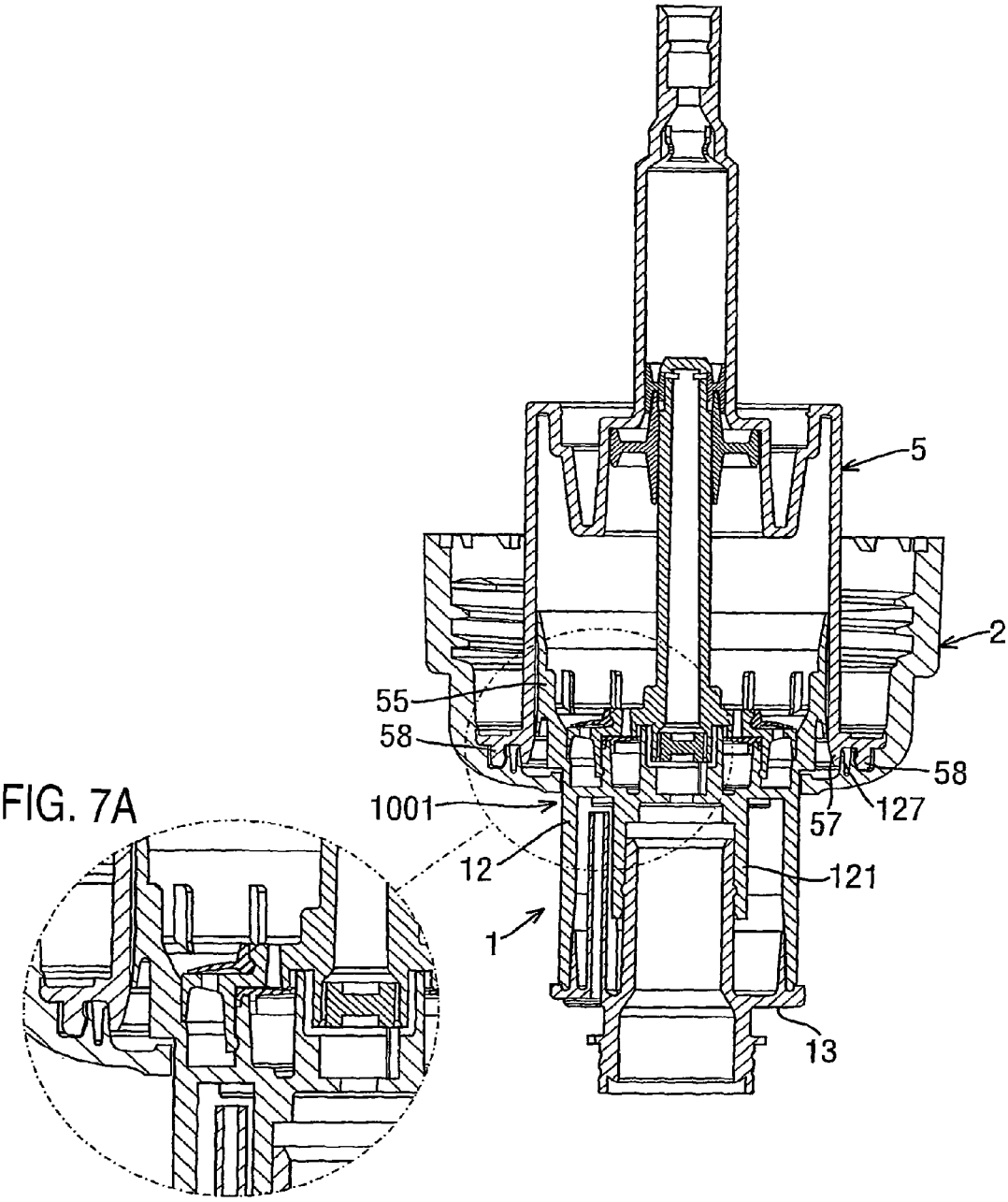
FIG. 7 shows a further variant with a different air cylinder/plunger construction, FIG. 7A showing an enlarged detail.

FIG. 7 shows a variant in which the outer shroud 12 of the plunger and the piston element 55 are formed in one moulded piece. This is possible because the plunger 1 uses the complementary end plug element 13 to enclose its interior cavity, and at the same time to enclose the internal core cavity trapping the foam-regulating mesh elements and to provide the pumping air vent. Thus, relative to the central core of the plunger mounting the various valve elements and securing to the liquid piston stem, the entire component 1001 involves surfaces open to the ends which can be made by withdrawal of mould components. Forming the plunger/piston in one piece in this way provides good structural integrity as well as reducing numbers of parts. The illustrated pump is for an inverted dispenser; the container is not shown but may be either a collapsible container or a fixed container vented as described above. Likewise an intake conduit arrangement is to be fitted, as described previously.

Figure 8:
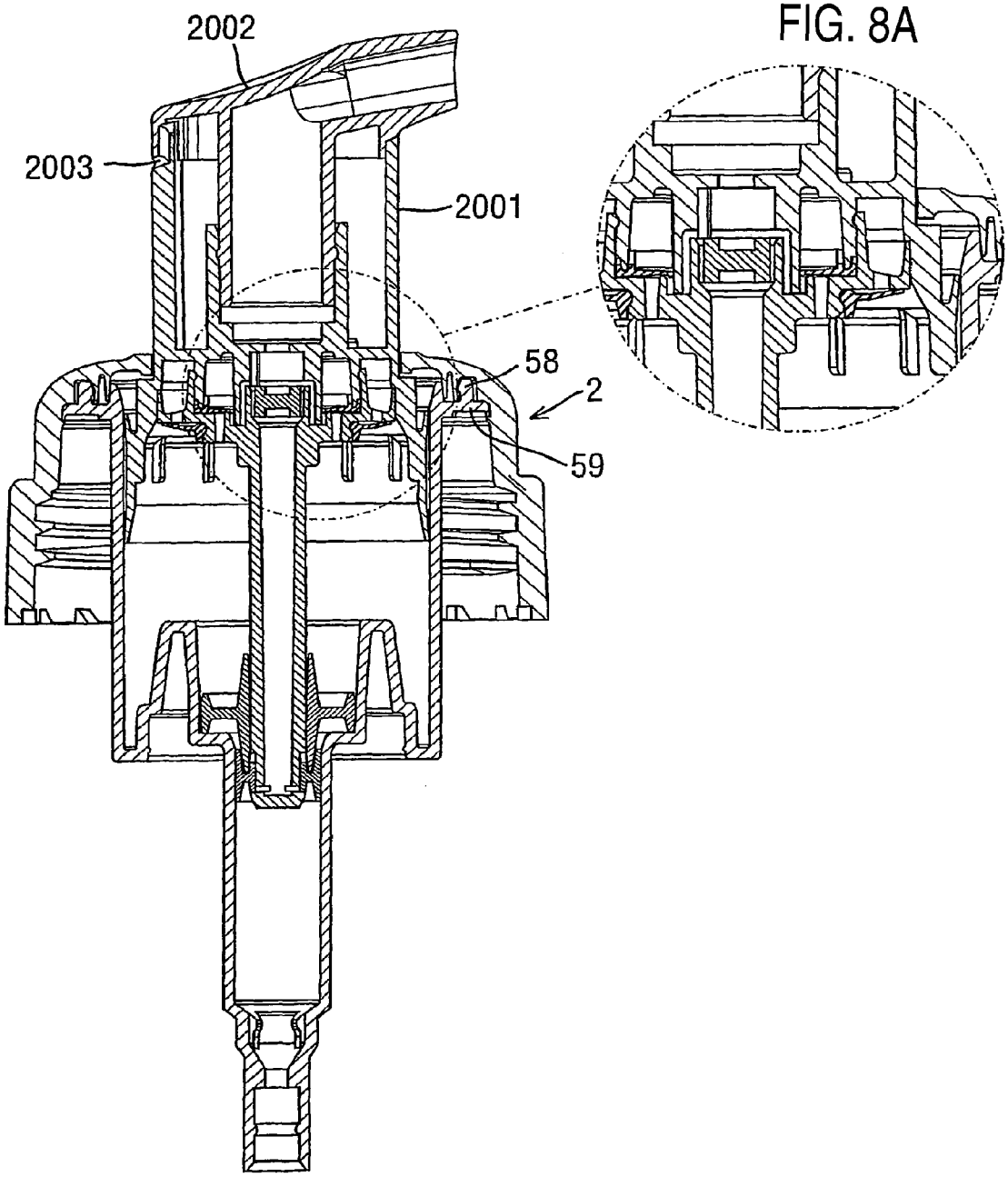
FIG. 8 shows the further variant construction embodied in an upright dispenser, again with FIG. 8A showing an enlarged detail.

FIG. 8 shows how certain of the described components may be exploited in an upright dispenser, in particular the one-piece plunger/cylinder component 2001. Again this can be moulded because the transverse components at the plunger top (spout, conformation of vent channels 2003) are provided in or by cooperation with a discrete end plug element 2002. Also shown here is the use in an upright dispenser of the cylinder flange 59 plugging into the underside of the cap 2.

A further variant shown in both FIGS. 7 and 8 is that the leading edge 57 of the cylinder component 5 (as distinct from the securing skirt 58 on its flange 59) fits inside a thin flexible sealing skirt 127 on the inside of the cap 2. This alternative to the solid skirt 27 seen in FIG. 6 can further improve fluid-tightness in this area.

The invention claimed is:

1. An apparatus, comprising:

an inverted foaming dispenser for dispensing foam, the dispenser including a liquid cylinder in which liquid is pumped to form the foam, an air cylinder in which air is pumped to form the foam, the air cylinder having a trough surrounding the liquid cylinder where the liquid cylinder extends from the air cylinder, the liquid cylinder having an inlet opening at an end opposite the air cylinder for drawing the liquid into the liquid cylinder, and a conduit shell received around the liquid cylinder to define an intake conduit, the conduit shell extending along the liquid cylinder from the inlet opening to the trough for drawing the liquid from the trough to the inlet opening via the intake conduit.

2. The apparatus of claim 1, in which the conduit shell has an outwardly flared portion that flares outwardly from the conduit shell.

3. The apparatus of claim 2, in which the outwardly flared portion includes a radial surface that is flattened.

4. The apparatus of claim 3, further comprising:

the trough having a snap bead; and the outwardly flared portion having a snap ring engaged to the snap bead.

5. The apparatus of claim 4, in which the radial surface has one or more through-openings.

6. The apparatus of claim 2, further comprising:

the trough having a snap bead; and the outwardly flared portion having a snap ring engaged to the snap bead.

7. The apparatus of claim 2, further comprising:

the trough having a snap bead; and the conduit shell having a snap ring engaged to the snap bead.

8. The apparatus of claim 1, further comprising:

the conduit shell including a radial surface that is flattened at the trough.

9. The apparatus of claim 8, in which one or more through-openings facilitate entry of the liquid into the trough.

10. The apparatus of claim 8, in which the conduit shell has an outwardly projecting channel with an intake channel, the intake channel extending along the liquid cylinder and through the radial surface that is flattened at the trough to draw the liquid from the trough to the inlet opening.

11. The apparatus of claim 1, in which the conduit shell has an outwardly projecting channel with an intake channel to draw the liquid from the trough to the inlet opening.

12. The apparatus of claim 1, further comprising:

an intermediate shell disposed between the conduit shell and the liquid cylinder.

13. The apparatus of claim 12, in which the intermediate shell includes an umbrella valve.

14. The apparatus of claim 1, further comprising:

the air cylinder including an air piston to pump the air; and the liquid cylinder including a liquid piston to pump the liquid.

* * * * *